US005381216A

United States Patent [19]

Osaka et al.

[11] Patent Number: 5,381,216

[45] Date of Patent: Jan. 10, 1995

[54] SEPARATING DEVICE FOR IMAGE FORMING APPARATUS

[75] Inventors: Haruya Osaka; Yoshiaki Tabata, both of Osaka, Japan

[73] Assignee: Mita Industrial Co., Ltd., Japan

[21] Appl. No.: 10,384

[22] Filed: Jan. 28, 1993

[30] Foreign Application Priority Data

Jan. 31, 1992 [JP] Japan ..... 4-016286

[51] Int. Cl.[6] ..... G03G 15/02

[52] U.S. Cl. ..... 355/221; 355/219

[58] Field of Search ..... 355/219, 221, 222, 227, 355/271, 274, 276; 250/324, 326; 361/225, 229

[56] References Cited

U.S. PATENT DOCUMENTS

| | | | |
|---|---|---|---|
| 3,604,925 | 9/1971 | Snelling et al. | 355/221 X |
| 4,227,234 | 10/1980 | Seanor et al. | 361/229 |
| 4,511,238 | 4/1985 | Hori | 355/271 |
| 4,640,606 | 2/1987 | Inamoto | 355/221 X |
| 4,876,578 | 10/1989 | Hara et al. | 250/326 X |
| 4,903,080 | 2/1990 | Taniguchi | 355/274 |
| 4,943,863 | 7/1990 | Ainoya | 355/271 |
| 4,974,026 | 11/1990 | Maruyama | 355/221 X |
| 4,978,998 | 12/1990 | Aizawa | 355/271 X |
| 5,142,329 | 8/1992 | Nakaya | 355/221 |

OTHER PUBLICATIONS

*Electrophotography*, "The Physical Phenomena of Corona Charging," by Schaffert, 1975.

*Primary Examiner*—A. T. Grimley
*Assistant Examiner*—Sandra L. Brasé
*Attorney, Agent, or Firm*—Beveridge, DeGrandi, Weilacher & Young

[57] ABSTRACT

A separating corona discharger 40 is provided with a first separating discharge wire 42 and a second separating discharge wire 43. The wire diameter of the first separating discharge wire 42 is set to, for example, 60 μm, and the wire diameter of the second separating discharge wire 43 is set to, for example, 100 μm. The first separating discharge wire 42 and the second separating discharge wire 43 are connected in parallel to an AC high-voltage power supply of a constant current type at the offset current. Accordingly, a large number of minus current components flow from the AC high-voltage power supply 46 into the discharge wire 42 having a small wire diameter from which discharge having minus components is easily induced, to obtain a desired distribution of a discharge having a large number of minus current components.

21 Claims, 8 Drawing Sheets

SEPARATING DEVICE FOR IMAGE FORMING APPARATUS

BACKGROUND OF THE INVENTION

1. Field of the Invention

The present invention relates to a separating device in an apparatus for forming an image using an electrophotographic system, for example, an electrophotographic copying machine, a laser beam printer and the like.

2. Description of the Prior Art

An electrophotographic copying machine, for example, is provided with a photosensitive drum. At the time of copying, the surface of the photosensitive drum is charged to a predetermined potential. The charged surface of the photosensitive drum is exposed to light corresponding to a document image. Consequently, charged charges are selectively eliminated from the surface of the photosensitive drum, so that an electrostatic latent image of the document image is formed. The electrostatic latent image is then developed using toner. Specifically, toner is applied to the surface of the photosensitive drum from which the charged charges are selectively eliminated by the exposure, so that the toner is electrostatically adsorbed only on a portion where the charged charges remain.

Thereafter, recording paper adheres to the photosensitive drum, so that transferring discharge is applied to the reverse surface of the paper (the surface opposite to the surface adhering to the photosensitive drum). For example, when the photosensitive drum using selenium for a photosensitive layer, the photosensitive drum is first positively charged. On the other hand, the toner is negatively charged, so that it is electrostatically adsorbed on positive charges which exist on the surface of the photosensitive drum. In this case, positive DC discharge is used as the transferring discharge. By this transferring discharge, strong positive charges are applied to the paper, so that the toner negatively charged which is electrostatically adsorbed on the positive charges on the photosensitive drum is electrostatically attracted by the positive charges on the paper.

After transfer, separating discharge is applied to the reverse surface of the paper. The separating discharge is induced so as to discharge the respective charges on the photosensitive drum, the paper and the toner and separate from the photosensitive drum the paper and the toner which are electrostatically adsorbed on the surface of the photo-sensitive drum. AC discharge having an offset value set to the minus side is generally used as the separating discharge. The positive charges on the paper are discharged by the separating discharge.

Meanwhile, in a separating corona discharger for inducing the separating discharge, various devices have been conventionally considered so as to reliably separate the paper from the photosensitive drum.

For example, Japanese Patent Laid-Open Gazette Nos. 115068/1980 and 115069/1980 have proposed a separating device in which a separating corona discharger is provided with two discharge wires and the respective discharge wires produce the effects of discharging which differ in magnitude, and a separating device in which at least two separating corona dischargers are provided and the respective dischargers produce the effects of discharging which differ in magnitude.

Furthermore, Japanese Utility Model Laid-Open Gazette No. 194759/1984 discloses a separating device in which a separating corona discharger is provided with two discharge wires, and the two discharge wires are made equal to each other in wire diameter and are made different from each other in height from the bottom surface of a shielding case to make discharge characteristics to paper by the discharge wires different from each other.

Furthermore, Japanese Patent Laid-Open Gazette No. 56978/1987 discloses a separating device in which a plurality of discharge electrodes having an equal shape are arranged in a separating corona discharger, and the respective electrodes are arranged at an equal distance from the surface of a photosensitive drum.

Various improvements have been thus conventionally proposed with respect to the separating devices using discharge. The reason for this is that the frequency of occurrence of inferior separation in separating the paper from the photosensitive drum is high due to, for example, the change in the use conditions, the environment or the like.

On the other hand, if paper is subjected to too excessive discharging by the separating device, a toner image once transferred to the paper is transferred again to the photosensitive drum, which is not preferable, as also described in the foregoing Japanese Patent Laid-Open Gazette No. 56978/1987. Alternatively, the toner image transferred to the paper is distorted even if it is not transferred again.

In the separating device, therefore, devices must be considered so as to discharge charged on the paper by transferring discharge, to satisfactorily separate the paper and the toner from the photosensitive drum and as not to distort the toner image transferred to the paper. In considering the devices, it is necessary to meet such conflicting conditions that the toner image is distorted if the separating performance is thought too important, while the separating performance is lowered if the image quality is thought important.

In the conventional separating devices, various devices are considered so as to meet the above described conflicting conditions. Examples are such a device that a so-called double wire structure in which two discharge wires are provided is used and the respective discharge wires are made different from each other in height from the bottom surface of a shielding case to make discharge characteristics by the discharge wires different from each other (for example, a separating device described in Japanese Utility Model Laid-Open Gazette No. 194759/1984), and such a device that separate power supplies are respectively connected to two discharge wires and different discharge voltages are applied to the discharge wires (for example, a separating device described in Japanese Patent Laid-Open Gazette No. 115068/1980).

In the separating device so constructed that the two discharge wires are made different from each other in height from the bottom surface of the shielding case, however, it is difficult to adjust the positional relationship between the path for paper and the separating device. The reason for this is that the distance between the discharge wire whose height is made large and the photosensitive drum is naturally decreased, so that the wire is easily brought into contact with the paper. In addition, if the height of the discharge wire is made large, shielding effects by the shielding case are degraded, so that stable discharge is not easily obtained and interference is liable to occur between separating discharge and transferring discharge. Furthermore, the ratio of minus and plus components cannot be altered for each wire.

On the other hand, the separating device so constructed that the discharge voltages are respectively supplied to the two discharge wires from the separate power supplies has the disadvantage in that two power supplies are required, thereby to complicate the separating device and increase the manufacturing cost.

SUMMARY OF THE INVENTION

Therefore, an object of the present invention is to provide a separating device for an image forming apparatus by which desired discharge characteristics are obtained, an image is not distorted, and paper and toner can be separated from a photosensitive drum more reliably in a structure entirely different from various structures conventionally proposed.

In the separating device according to the present invention, a first discharger formed in such a shape that discharge having a large number of primary discharging components is easily induced is arranged on the upstream side on the basis of the delivery direction of a sheet-shaped recording medium to which a toner image is transferred. In addition, a second discharger formed in such a shape that discharge having a large number of primary discharging components is not induced more easily than the first discharger is arranged on the downstream side on the basis of the delivery direction of the sheet-shaped recording medium. The first discharger and the second discharger are together connected to an AC power supply for supplying discharge power.

According to the present invention, it is possible to increase the number of primary discharging components having The high effect of discharging on the upstream side and decrease the number of primary discharging components so that an image is not easily distorted on the downstream side with respect to the contents of discharge, and to strengthen or weaken the discharge distribution along the delivery direction of the sheet-shaped recording medium, thereby to make it possible to induce efficient separating discharge with an image being hardly distorted.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

The construction of a separating device will be described in detail by taking an electrophotographic copying machine as an example.

Figure 1:
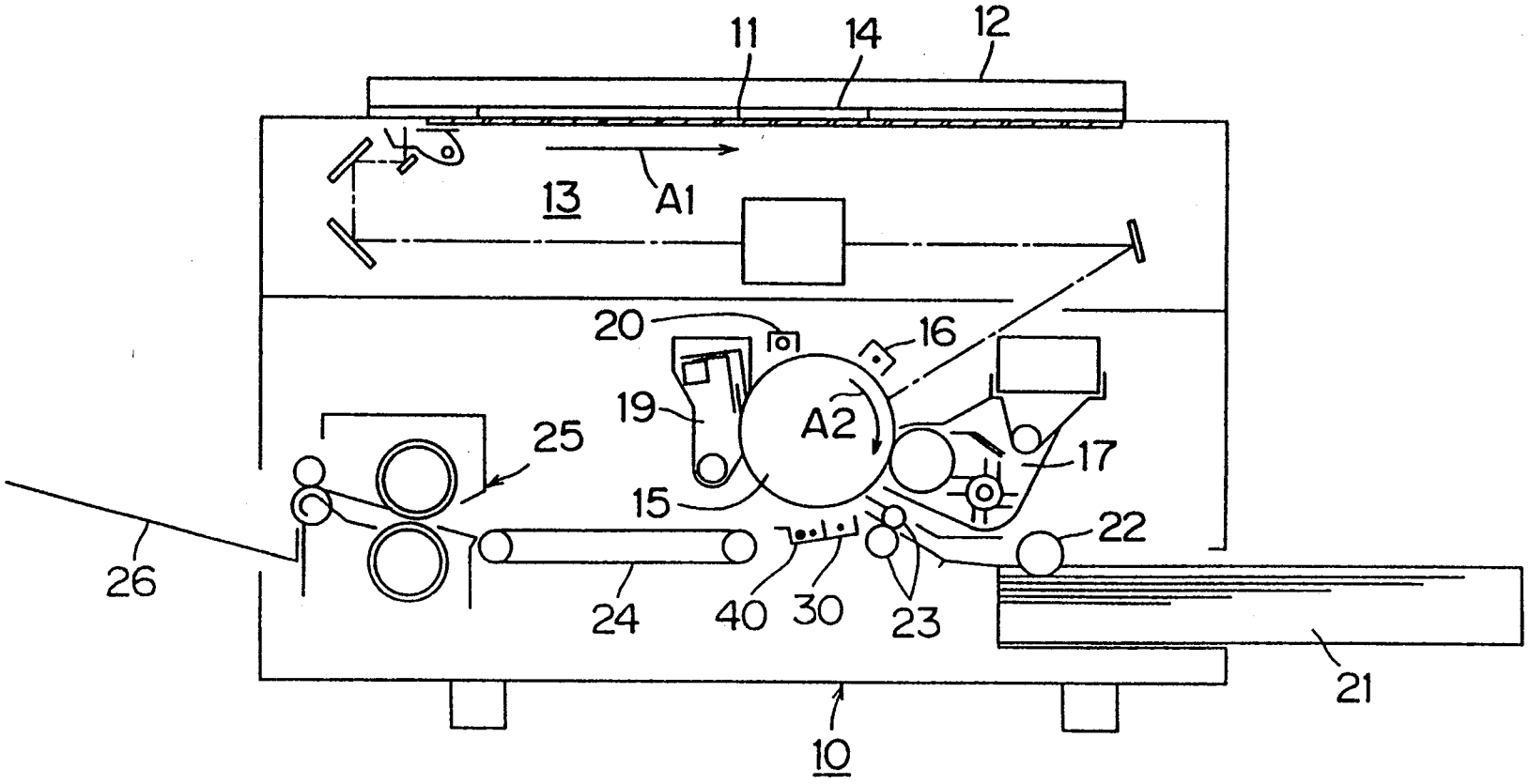
FIG. 1 is a cross sectional view showing the schematic construction of an electrophotographic copying machine to which one embodiment of the present invention is applied.

FIG. 1 is a cross sectional view showing the schematic construction of an electrophotographic copying machine 10 to which one embodiment of the present invention is applied.

A document cover 12 for covering a transparent platen 11 and a document 14 on the transparent platen 11 is provided on the upper surface of the copying machine 10, and an optical system 13 is provided in the upper part of the inside of the copying machine 10. The optical system 13 is moved in the direction indicated by an arrow A1 for illuminating the document 14 mounted on the transparent platen 11, introducing light reflected from the document 14 into a photosensitive drum 15, and exposing the surface of the photosensitive drum 15 to the light.

The photosensitive drum 15 is in a drum shape using, for example, selenium as a photoreceptor, and is rotated at constant speed in the direction indicated by an arrow A2 at the time of a copying operation.

A charging corona discharger 16 for charging the surface of the photosensitive drum 15 to a constant potential, a developing device 17 for developing an electrostatic latent image with toner adhering to the surface of the photosensitive drum 15 after the exposure, a transferring corona discharger 30 for transferring a toner image on the surface of the photosensitive drum 15 to paper, a separating corona discharger 40 for separating the paper to which the toner image is transferred from the photosensitive drum 15, a cleaner 19 for removing the residual toner on the surface of the photosensitive drum 15, and a erase lamp 20 for neutralizing the residual charges on the surface of the photosensitive drum 15, and the like are provided around the photosensitive drum 15 along the direction of rotation A2 of the photosensitive drum 15.

Furthermore, a paper feeding cassette 21 is detachably mounted on the copying machine 10, and paper contained in the paper-feeding cassette 21 is taken out by a paper feeding roller 22 and applied to a registration roller 23. The registration roller 23 is for applying the paper to the photosensitive drum 15 at predetermined timing in synchronism with the exposure of the photosensitive drum 15 to the light introduced by the optical system 13 to form a document image. In addition, the copying machine 10 is provided with a delivery belt 24 for conveying the paper separated by the separating corona discharger 40, a fixing device 25 for fixing the toner image on the paper, a discharge tray 26 for discharging the paper to which the toner image is fixed to terminate copying, and the like.

Figure 2:
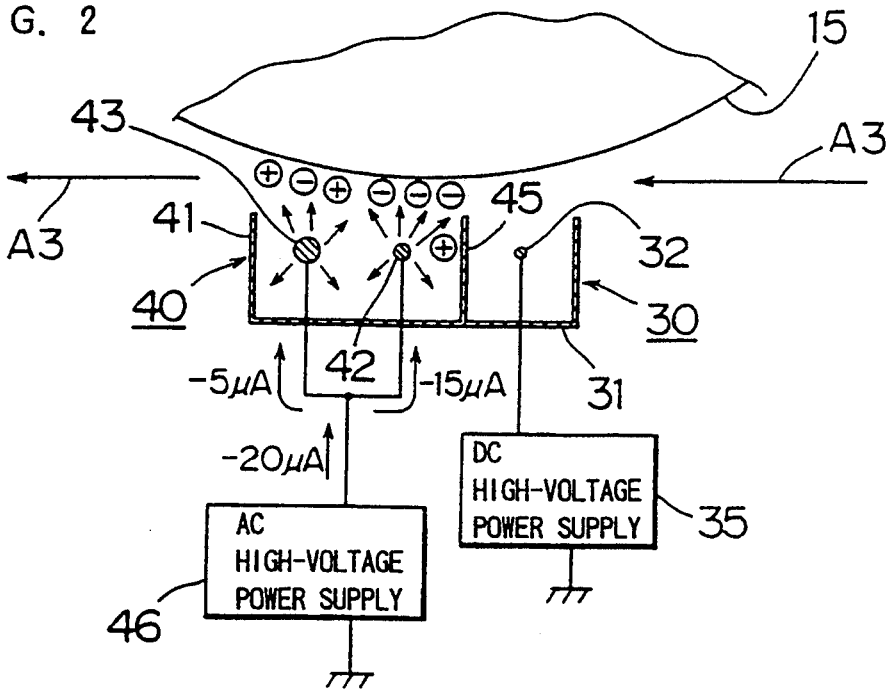
FIG. 2 is an illustration for explaining the construction of a separating device according to one embodiment of the present invention which is provided for the electrophotographic copying machine.

FIG. 2 is an illustration for explaining the construction of a separating device according to one embodiment of the present invention which is provided for the above described copying machine 10. FIG. 2 illustrates the construction of the separating device according to the present embodiment which is cut along a plane surface at Eight angles to the longitudinal direction. In FIG. 2 reference numeral 15 denotes a photosensitive drum, 30 denotes a transferring corona discharger, and 40 denotes a separating corona discharger. The transferring corona discharger 30 is arranged on the upstream side in the paper delivery direction A3, and the separating corona discharger 40 is arranged adjacent to the transferring corona discharger 30 and on the downstream side in the paper delivery direction A3.

The transferring corona discharger 30 comprises a shielding case 31 and a discharge wire 32 stretched in the shielding case 31. The shielding case 31 is formed by folding a thin metal plate superior in conductivity, for example, in a boat shape. A tungsten wire or a stainless wire having a wire diameter of, for example, 60 μm is used as the discharge wire 32. A DC high-voltage power supply 35 is connected to the discharge wire 32. At the time of transferring discharge, a DC voltage is supplied from the DC high-voltage power supply 35 to the discharge wire 32, so that the discharge wire 32 induces positive DC discharge.

On the other hand, the separating corona discharger 40 comprises a shielding case 41 and two separating discharge wires 42 and 43 stretched in the shielding case 41. The shielding case 41 is formed by folding a thin metal plate superior in conductivity in a boat shape, similarly to the shielding case 31 in the transferring corona discharger The transferring corona discharger 40 and the transferring corona discharger 30 are partitioned by a partitioning plate The first separating discharge wire 42 and the second separating discharge wire 43 are arranged on the relatively upstream side and the relatively downstream side in the paper delivery direction A3. The present embodiment is characterized in that the wire diameter of the first separating discharge wire 42 is relatively small, for example, 60 μm, while the wire diameter of the second discharge wire 43 is relatively large, for example, a suitable size within the range of over 60 μm to 100 μm. In addition, an AC high-voltage power supply 46 is connected to the first separating discharge wire 42 and the second separating discharge wire 43. Specifically, the first separating discharge wire 42 and the second separating discharge wire 43 are connected in parallel to the AC high-voltage power supply 46.

Description is now made of the principle of AC discharge using discharge wires.

Figure 3:
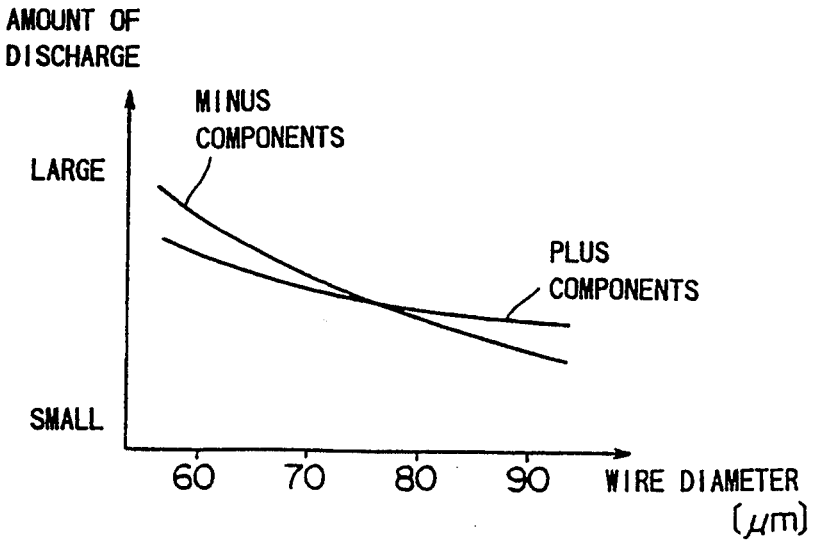
FIG. 3 is a graph showing the relationship between the wire diameter of a separating discharge wire for inducing AC discharge by the supply of AC power and plus discharge components and minus discharge components included in the AC discharge.

FIG. 3 is a graph showing the relationship between the wire diameter [μm] of a separating discharge wire for inducing AC discharge by the supply of AC high-voltage power and plus discharge components and minus discharge components included in the AC discharge. As shown in FIG. 3, in the AC discharge, the smaller the wire diameter is, the larger the number of minus components included in the discharge is. 0n the other hand, the larger the wire diameter is, the smaller the number of minus components included in the discharge is. In addition, the smaller the wire diameter is, the larger the total amount of discharge is.

Consequently, if a discharge wire having a relatively large wire diameter and a discharge wire having a relatively small wire diameter are connected in parallel to a single AC high-voltage power supply, AC discharge having a large number of minus components is induced using the discharge wire having a small wire diameter a relatively large number of times, while AC discharge having a small number of minus components is induced using the discharge wire having a large wire diameter a relatively small number of times. Therefore, merely by connecting a plurality of separating discharge wires which differ in wire diameter in parallel to the AC high-voltage power supply, it is possible to so set the ratios of minus discharge components discharged from the respective discharge wires and also the amounts of discharge from the respective discharge wires as to differ from each other. The set values can be adjusted in desired ranges by selecting the wire diameters of the discharge wires used. As a result, it is possible to realize separating discharge which allows the separating performance to be improved without distorting an image.

If the separating device is constructed as shown in FIG. 2, there arises a difference in components of AC current flowing into the first separating discharge wire 42 and the second separating discharge wire 43 from the AC high-voltage power supply 46. For example, it is assumed that the offset value of the AC current outputted from the AC high-voltage power supply 46 is set to −20 μA, that is, a value on the minus side. In addition, it is assumed that the AC high-voltage power supply 46 is a power supply of a constant current type at the offset current. In this case, the number of minus components becomes large in discharge from the first separating discharge wire 42 having a small wire diameter. On the other hand, the number of minus components becomes small in discharge from the second separating discharge wire 43 having a large wire diameter. Therefore, the offset value of current flowing into the first separating discharge wire 42 is, for example, −15 μA, and the offset value of current flowing into the second separating discharge wire 43 is, for example, −5 μA. In addition, the discharge from the first separating discharge wire 42 become relatively strong, while the discharge from the second separating discharge wire 43 become relatively weak.

Specifically, in the paper delivery direction A3, strong AC discharge having a large number of minus components is induced on the upstream side, while soft AC discharge having a small number of minus components is induced on the downstream side.

If the discharge distribution caused by the separating corona discharger 40 is the above described distribution, the following effect is given. The paper after the transfer by the transferring corona discharger 30 is still strongly electrostatically adsorbed on the surface of the photosensitive drum 15. Therefore, on the upstream side in the paper delivery direction A3, the paper strongly electrostatically adsorbed on the photosensitive drum 15 can be subjected to strong discharging for separation, that is, strong AC discharge having a large number of minus components. Thereafter, on the downstream side, the paper can be further subjected to soft AC discharge having a small number of minus components and also having a small amount of discharge so that an image is hardly distorted can be induced before and after the moment the paper is actually separated from the photosensitive drum 15.

Particularly in the present embodiment, it is possible to cause the first separating discharge wire 42 to induce AC discharge having a large number of minus components and also having a large amount of discharge without increasing an output voltage of the AC high-voltage power supply 46 and increasing the height of the first separating discharge wire 42 from the bottom surface of the shielding case 41 to bring the first separating discharge wire 42 near the photosensitive drum 15 as in the conventional separating device, thereby to make it possible to improve the separating performance without increasing discharge interference with the transferring corona discharger 30. Specifically, in the conventional technique equal to a case where a voltage is merely increased, spark discharge is liable to be induced, and an image is distorted due to the spark discharge. In addition, a leak is liable to be developed, and an image is distorted due to leak current. Further, the separating discharge and the transferring discharge may, in some cases, interact with each other to distort an image. According to the present invention, however, it is possible to enhance the function of discharging without increasing a voltage, thereby to obtain such effects that the separating capability can be substantially increased and an image is not distorted.

Additionally, on the downstream side in the paper delivery direction A3, the paper can be subjected to supplementary discharging in which an image is hardly distorted by the second separating discharge wire 43. Consequently, it is possible to perform reliable separation with an image being stable with respect to the changes in various factors.

Furthermore, the power supply to the separating corona discharger 40 may be one AC high-voltage power supply 46, thereby to make it possible to make the construction of the separating corona discharger 40 simple and low in cost as in the conventional example.

Specifically, the present invention is characterized in that the discharge wire having a relatively small wire diameter and the discharge wire having a relatively large wire diameter are combined with each other, to obtain discharge having an increased number of minus components and also having a large amount of discharge so that the capability to neutralize charges is high in discharge using the discharge wire having a relatively small wire diameter, while obtaining so-called soft discharge having a small number of minus components and also having a small amount of discharge so that an image is not easily distorted in discharge using the discharge wire having a relatively large wire diameter. Generally, it is preferable that separating discharge always meeting the same conditions are not induced when paper is separated from the photosensitive drum 15, but the components and the strength of discharge for neutralization are gradually changed depending on the contact state between the paper and the photosensitive drum 15. According to the present invention, it is possible to meet the above described requirements, and gradually change discharge characteristics in the separating discharge along the paper delivery direction A3.

Figure 4A:
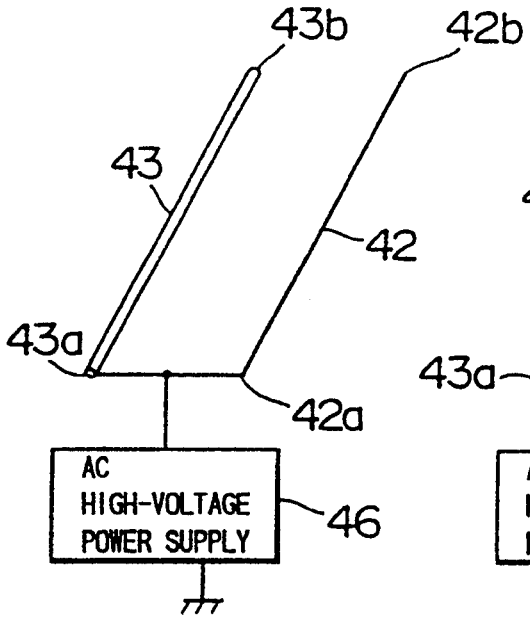
FIG. 4 is a diagram showing the connection between two separating discharge wires and an AC high-voltage power supply.
Figure 4B:
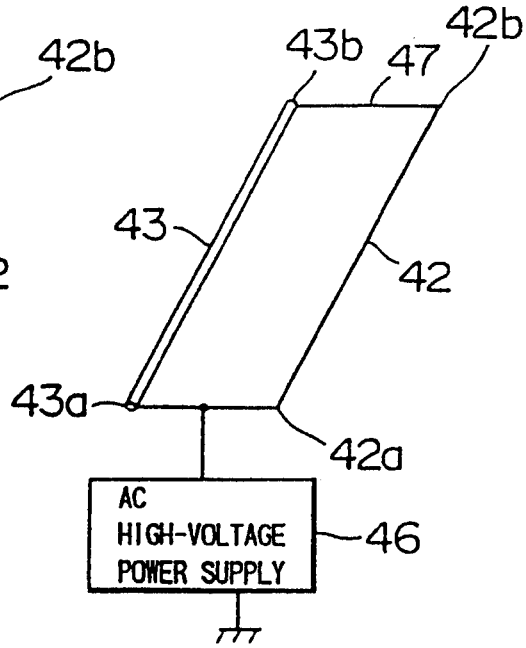

Meanwhile, in the connection between the two separating discharge wires 42 and 43 and the AC high-voltage power supply 46, the AC high-voltage power supply 46 may be connected to both respective ends **42*a* and 43*a* of the first separating discharge wire 42 and the second separating discharge wire 43, and the other ends 42*b* and 43*b* of the first separating discharge wire 42 and the second separating discharge wire 43 may be respectively in the opened state, as shown in FIG. 4** (*a*). Alternatively, the respective other ends **42*b* and 43*b* of the first separating discharge wire 42 and the second separating discharge wire 43 may be electrically connected to each other by a connecting line 47, as shown in FIG. 4** (*b*).

Figure 5:
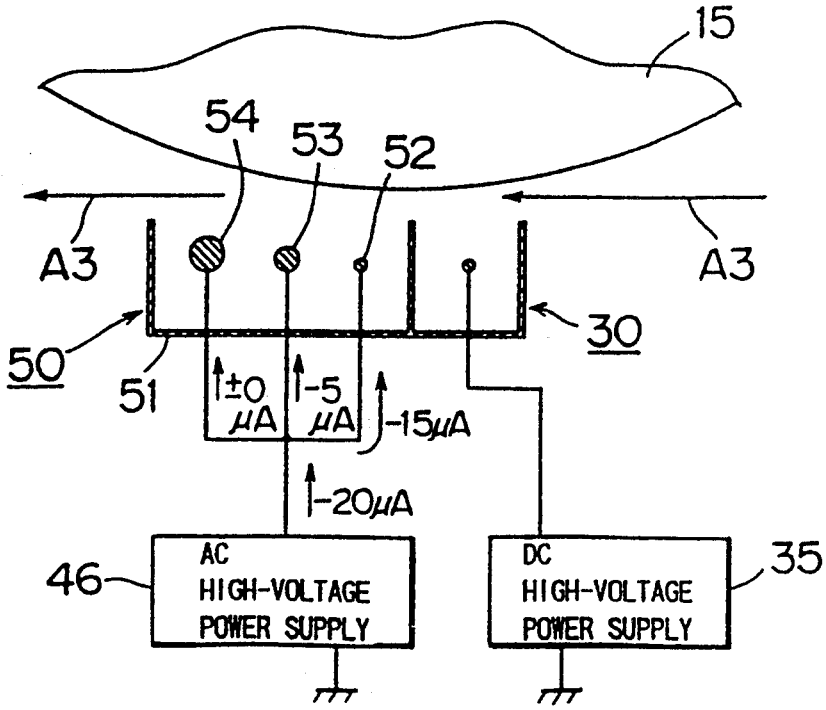
FIG. 5 is a cross sectional view illustrating the construction of a separating device according to another embodiment of the present invention.

FIG. 5 is a cross sectional view illustrating the construction of a separating corona discharger 50 according to another embodiment of the present invention. Although in the embodiment shown in FIG. 3, description is made of an example in which two separating discharge wires are provided, three separating discharge wires may be stretched as shown in FIG. 5.

Description is made more concretely with reference to FIG. 5. The separating corona discharger 50 is arranged on the downstream side of a transferring corona discharger in the paper delivery direction A3. The separating corona discharger 50 has a boat-shaped shielding case 51 formed of, for example, a thin metal plate superior in conductivity, and three discharge wires 52, 53 and 54 arranged in the shielding case 51. The three discharge wires 52, 53 and 54 are stretched with predetermined spacing in the order from the upstream side to the downstream side in the paper delivery direction A3. The heights of the three wires 52, 53 and 54 from the bottom surface of the shielding case 51 may be equal to each other. Alternatively, the heights of the three wires may be so set that the distances from the photosensitive drum 15 are equal to each other. In the case, the height of the wire located on the downstream side from the bottom surface of the shielding case 51 is slightly larger.

The present embodiment is characterized in that the wire diameters of the first separating discharge wire the second separating discharge wire 58 and the third separating discharge wire 54 are increased in that order. For example, the wire diameters of the first separating discharge wire 52, the second separating discharge wire 53, and the third separating discharge wire 54 are respectively taken as 60 $\mu$m, $60+\alpha\mu$m, and $60+\beta\mu$m; where $\alpha$ is smaller than $\beta$ and $\alpha$ and $\beta$ are within the range of 1 $\mu$m to 40 $\mu$m. In addition, current is supplied in parallel to the three separating discharge wires 52, 53 and 54 from an AC high-voltage power supply 46. The AC high-voltage power supply 46 is, for example, a power supply of a constant current type at the offset current. If the offset value of the current is, for example, $-20$ $\mu$A, current having a large number of minus components flows into the discharge wire having a relatively small wire diameter. For example, AC current having an offset value of $-15$ $\mu$A, AC current having an offset value of $-5$ $\mu$A, and AC current having an offset value of $\pm 0$ $\mu$A are respectively supplied to the first separating discharge wire 52, the second separating discharge wire 53, and the third separating discharge wire 54. In addition, discharge is induced more easily from the discharge wire having a relatively small wire diameter, so that a relatively large amount of current flows thereto.

Consequently, also in the construction shown in FIG. 5, AC discharge having a large number of minus components so that the capability to neutralize charges is high is obtained on the upstream side in the paper delivery direction A3, and AC discharge having a small number of minus components so that an image is hardly distorted is obtained on the downstream side.

In the embodiment shown in FIG. 5, all the wire diameters of the three discharge wires need not be made different from each other. For example, the wire diameter of the first separating discharge wire 52 may be relatively small (for example, 60 μm), and the wire diameters of the second separating discharge wire 53 and the third separating discharge wire 54 may be equal to each other and relatively large (For example, 70 to 100 μm). Alternatively, the separating corona discharger may be constituted by not less than four wires.

Figure 6:
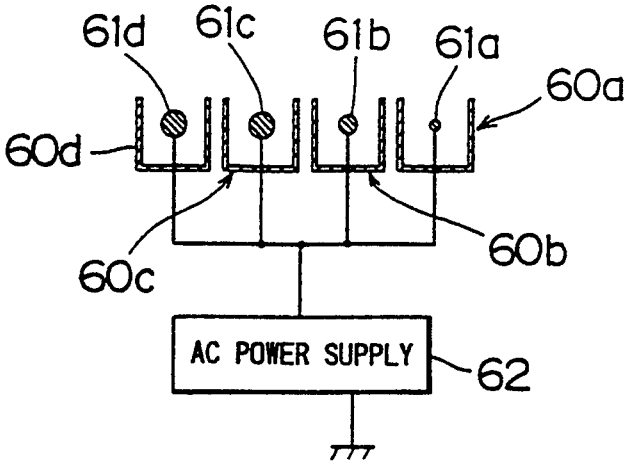
FIG. 6 is a cross sectional view illustrating the construction of a separating device according to still another embodiment of the present invention.

FIG. 6 is an illustration for explaining the construction of a separating corona discharger 60 according to still another embodiment of the present invention. As shown in FIG. 6, the separating corona discharger 60 may be so constructed that a plurality of separating corona dischargers 60*a*, 60*b*, 60*c* and 60*d* are arranged so as to be adjacent to each other along the paper delivery direction A3, the wire diameter of a discharge wire 61*a* in the separating corona discharger 60*a* is taken as, for example, 60 μm, the wire diameter of a discharge wire 61*b* in the separating corona discharger 60*b* is taken as $60+\alpha\mu m$, and the wire diameters of both discharge wires 61*c* and 61*d* in the separating corona dischargers 60*c* and 60*d* are taken as $60+\beta\mu m$, and current is supplied in parallel from a single AC power supply 62 to the respective discharge wires 61*a*, 61*b*, 61*c* and 61*d*.

Figure 7:
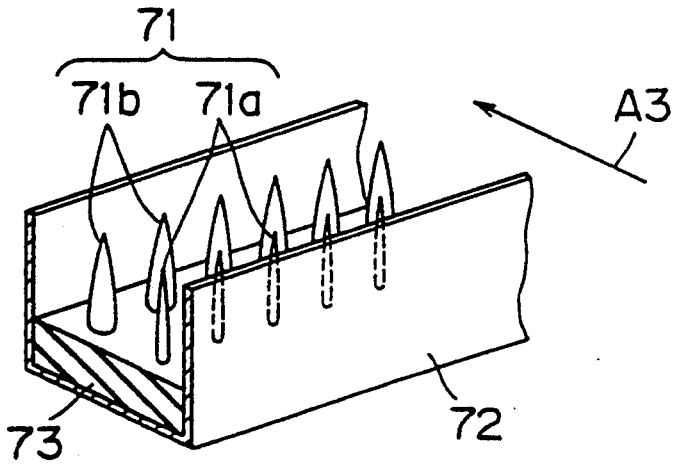
FIG. 7 is a diagram for explaining a separating device according to still another embodiment of the present invention.

Furthermore, separating discharge can be also induced using not the discharge wires as in the above described embodiments but, for example, a needle electrode 71 as shown in FIG. 7. In the case of discharge using the needle electrode 71 shown in FIG. 7, the wire diameter of a needle electrode 71*a* on the relatively upstream side in the paper delivery direction A3 may be made small, while the wire diameter of a needle electrode 71*b* on the relatively downstream side may be made large. In FIG. 7, reference numeral 72 denotes a shielding case, and reference numeral 713 denotes an insulating stand.

Figure 8:
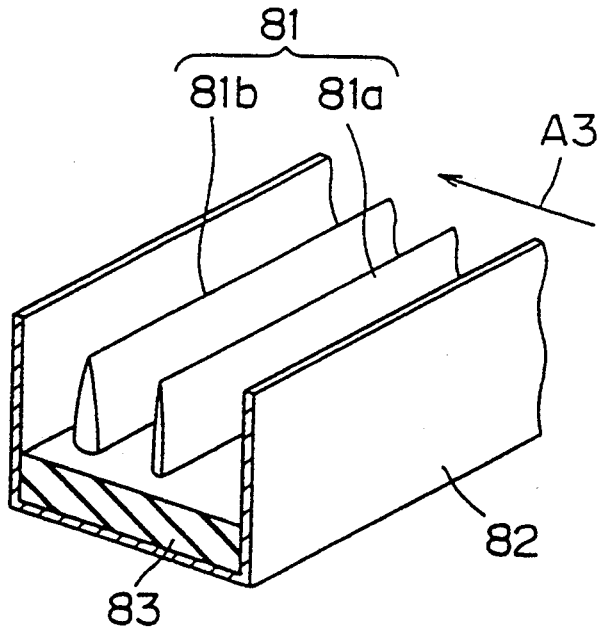
FIG. 8 is a diagram for explaining the construction of a separating device according to still another embodiment of the present invention.

Furthermore, as shown in FIG. 8, there can be also provided a separating corona discharger 80 for inducing separating discharge using a plate-shaped electrode 81. Also in this case, the thickness of a plate-shaped electrode 81a located on the relatively upstream side in the paper delivery direction A3 may be made relatively small, while the thickness of a plate-shaped electrode 81*b* located on the downstream side may be made relatively large. In FIG. 8, reference numeral 82 denotes a shielding case, and reference numeral 83 denotes an insulating stand.

Figure 9:
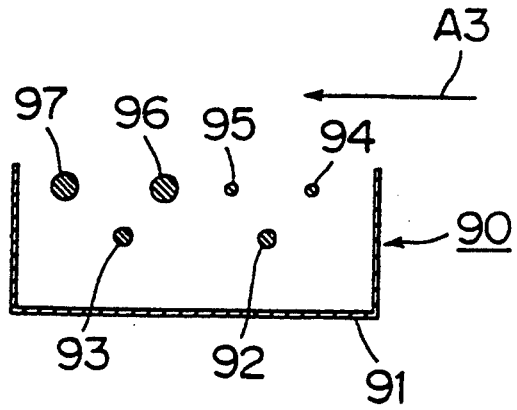
FIG. 9 is a cross sectional view illustrating the construction of a separating device according to still another embodiment of the present invention.

FIG. 9 is a cross sectional view illustrating the construction of a separating corona discharger according to another embodiment. In FIG. 9, A3 is the paper delivery direction, reference numeral 90 denotes a separating corona discharger, reference numeral 91 denotes a shielding case, and reference numerals 92 and 93 denote separating discharge wires. The present embodiment is characterized in that grid wires 94, 95, 96 and 97 are provided above the separating discharge wires 92 and 93, and control is so carried out that the wire diameters of the grid wires 94, 95, 96 and 97 are made different from each other so that a distribution of the discharge having a large number of primary discharging components caused by the discharge wires 92 and 93 becomes a desired distribution. Even if the wire diameters of the discharge wires 92 and 93 are made equal to each other, the discharge distribution can be adjusted by making the wire diameters of the grid wires 94, 95, 96 and 97 different from each other as in the present embodiment.

Meanwhile, when the grid wires are used, the discharge distribution caused by the discharge wires 92 and 93 can be changed also by changing the wire spacing between the grid wires or changing voltages applied to the grid wires.

Figure 10:
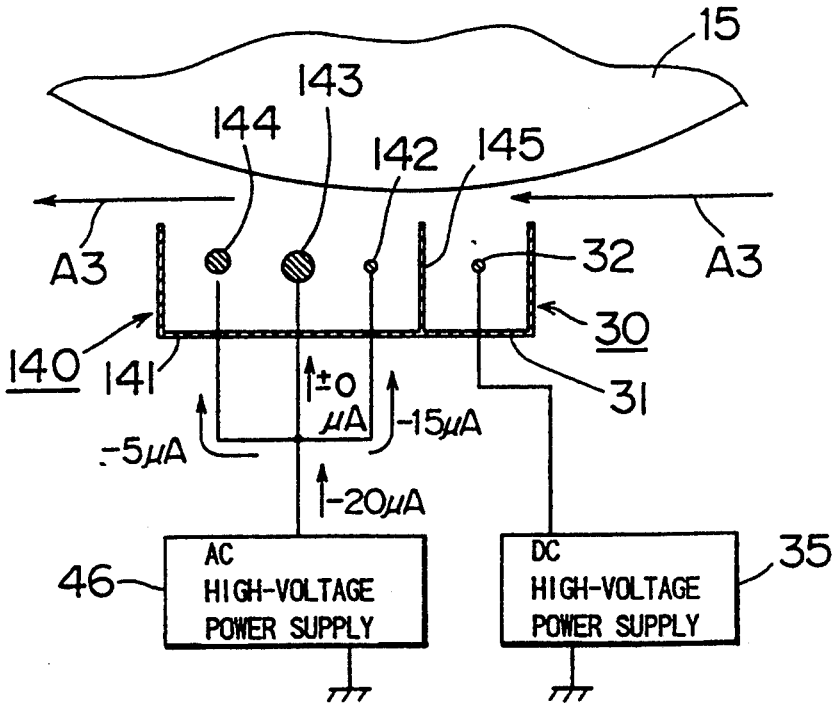
FIG. 10 is an illustration for explaining the construction of a separating device according to a further embodiment of the present invention.

FIG. 10 is an illustration for explaining the construction of a separating device according to another embodiment of the present invention. In FIG. 10, the same reference numerals are assigned to the same portions as those shown in FIG. 2. Specifically, in FIG. 10, reference numeral 15 denotes a photosensitive drum, 30 denotes a transferring corona discharger, and 140 denotes a separating corona discharger. The transferring corona discharger 30 is arranged on the upstream side in the paper delivery direction AS, and the separating corona discharger 140 is arranged adjacent to the transferring corona discharger 30 and on the downstream side in the paper delivery direction A3.

The separating corona discharger 140 comprises a shielding case 141 and three separating discharge wires 142, 143 and 144 stretched in the shielding case 141. The shielding case 141 is formed by folding a thin metal plate superior in conductivity in a boat shape, similarly to a shielding case 31 in the transferring corona discharger 30. The separating corona discharger 140 and the transferring corona discharger 30 are partitioned by a partitioning plate 145.

The first separating discharge wire 142, the second separating discharge wire 143 and the third separating discharge wire 144 are arranged in the order from the relatively upstream side in the paper delivery direction A3. The present embodiment is characterized in that the wire diameter of the first separating discharge wire 142 is relatively small, the wire diameter of the second separating discharge wire 143 is relatively large, and the wire diameter of the third separating discharge wire 144 is a size between the sizes of the wire diameter of the first and second separating wires 142 and 143. In addition, an AC high-voltage power supply 46 is connected as an AC power supply to the first separating discharge wire 142, the second separating discharge wire 143 and the third separating discharge wire 144. Specifically, the first separating discharge wire 142, the second separating discharge wire 143 and the third separating discharge wire 144 are connected in parallel to the AC high-voltage power supply 46.

in such construction, there arises a difference in components and amount of AC current flowing into the first separating discharge wire 142, the second separating discharge wire 143 and the third separating discharge wire 144 from the AC high-voltage power supply 46. For example, it is assumed that the offset value of the AC current outputted from the AC high-voltage power supply 46 is set to −20 μA, that is, a value on the minus side. In addition, it is assumed that the AC high-voltage power supply 46 is a power supply of a constant current type at the offset current. In this case, the offset value of current flowing into the first separating discharge wire 142 having the smallest wire diameter is, for example, −15 μA, the offset value of current flowing into the third separating discharge wire 144 having the second smallest wire diameter is, for example, −5 μA, and the offset value of current flowing into the second separating discharge wire 143 having the largest wire diameter is, for example, ±0 μA. Therefore, the largest number of minus components are included in discharge from the first separating discharge wire 142, the second largest number of minus components are included in discharge from the third separating discharge wire 142, and the smallest number of minus components are included in discharge from the second separating discharge wire 143. In addition, the discharge from the first separating discharge wire 142, the discharge from the third separating discharge wire 144, and the discharge from the second separating discharge wire 143 are strengthened in that order.

Specifically, after the discharge using the first separating discharge wire 142, the paper can be subjected to supplementary discharging in which an image is hardly distorted using the second separating discharge wire 143. Consequently, it is possible to reliably separate the paper with an image being stable with respect to the changes in various factors. Thereafter, slightly strong discharge having a large number of minus components is induced using the third separating discharge wire 144. Therefore, the paper once separated from the photosensitive drum 15 is subjected to supplementary discharging for making the discharge complete so that the paper is not adsorbed on the photosensitive drum 15 again.

Furthermore, the power supply to the separating corona discharger 140 may be one AC high-voltage power supply 46, thereby to make it possible to make the construction of the separating corona discharger 140 simple and low in cost.

In the above described embodiment shown in FIG. 10, the wire diameter of the first separating discharge wire 142 may be taken as a larger size than the wire diameter of the third separating discharge wire 144. Alternatively, the wire diameters of the first and third separating discharge wires 1142 and 144 may be equal to each other. What is important is that the wire diameter of the second separating discharge wire 143 located in the center is made larger than the wire diameters of the first and third separating discharge wires 142 and 144.

Furthermore, the number of second separating discharge wires 14S located in the center may be plural. That is, the separating corona discharger may be constructed using four or more discharge wires.

Specifically, a discharge wire having a relatively small wire diameter and a discharge wire having a relatively large wire diameter may be combined with each other, to obtain discharge having a large number of minus components and also having a large amount of discharge so that the capability to neutralize charges is high in the discharge using the discharge wire having a relatively small wire diameter, while obtaining so-called soft discharge having a small number of minus components and also having a small amount of discharge so that an image is not easily distorted in the discharge using the discharge wire having a relatively large wire diameter.

Although in the above described embodiments, the transferring corona discharger 30 adjacent on the upstream side of the separating corona discharger 40 serving as a separating device (see, for example, FIG. 2) has one transferring discharge wire 32, the number of transferring discharge wires in the transferring corona discharger 30 may be plural.

Figure 11:
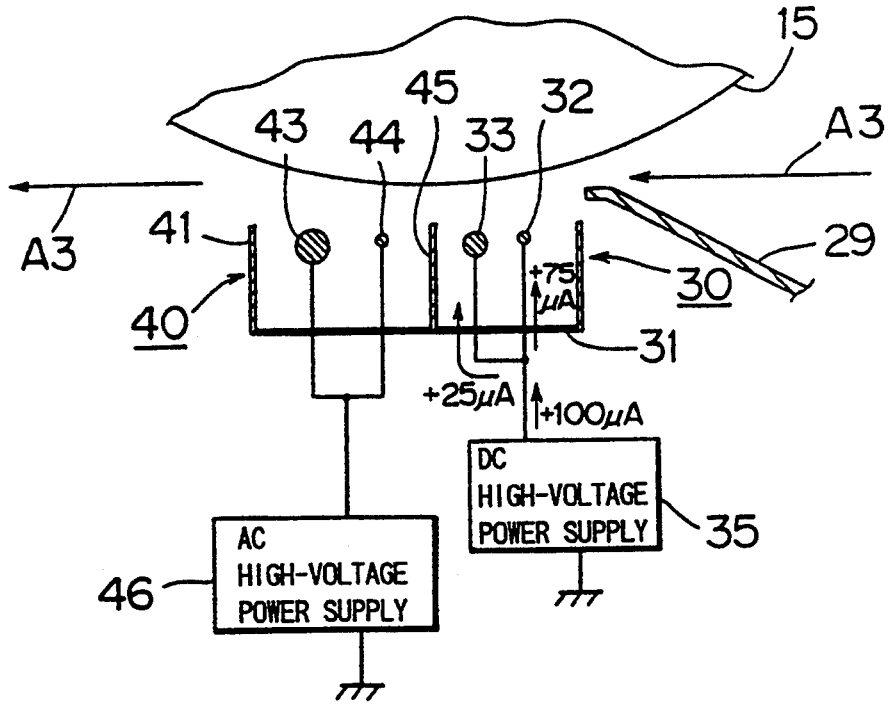
FIG. 11 is an illustration in which the separating device according to one embodiment of the present invention is combined with a transferring corona discharger comprising two discharge wires.

For example, the transferring corona discharger may be constructed as shown in FIG. 11. Description is made with reference to FIG. 11. A transferring corona discharger 30 comprises a shielding case 31 and two transferring discharge wires 32 and 33 stretched in the shielding case 31. The shielding case 31 is formed by folding, for example, a thin metal plate superior in conductivity in a boat shape. A first transferring discharge wire 32 out of the two transferring discharge wires is arranged on the relatively upstream side in the paper delivery direction A3, while a second transferring discharge wire 3S is arranged on the relatively downstream side. The wire diameter of the first transferring discharge wire 32 is relatively small, while the wire diameter of the second transferring discharge wire 33 is relatively large. In addition, a DC high-voltage power supply 35 is connected as a DC power supply to the first transferring discharge wire 32 and the second transferring discharge wire 33. Specifically, the first transferring discharge wire 32 and the second transferring discharge wire 33 are connected in parallel to the DC high-voltage power supply 35.

In such construction, there arises a difference in current flowing into the first transferring discharge wire 32 and the second transferring discharge wire 33 from the DC high-voltage power supply 35. For example, it is assumed that the DC high-voltage power supply 35 is a power supply of a constant current type, and its output current is +100 μA. In this case, the output current is always constant. +75 μA of the output current +100 μA flows into the first transferring discharge wire 32, and +25 μA thereof flows into the second transferring discharge wire 33. The amount of discharge from the first transferring discharge wire 32 is relatively large, while the amount of discharge from the second transferring discharge wire 33 is relatively small.

Specifically, in the paper delivery direction A3, strong transferring discharge is induced on the upstream side, while soft transferring discharge is induced on the downstream side.

If the discharge distribution caused by the transferring corona discharger 30 is the above described distribution, the following effect is given. Specifically, since discharge on the downstream side of the transferring discharge, that is, on the side near separating discharge is weak, interference between the transferring discharge and the separating discharge is weakened, to smooth the transition from transfer to separation. As a result, the transfer is satisfactorily performed with an image being hardly distorted and the separating characteristics by the separating discharge induced after that are improved. It is generally said that it is preferable that the transition from transferring discharge to separating discharge gradually and smoothly occurs. In such construction, therefore, it is possible to satisfy the above described discharge distribution which is said to be good, thereby to make it possible to improve the performance of the separating device.

Furthermore, the first transferring discharge wire 32 in the transferring corona discharger 30 induces sufficiently strong transferring discharge, thereby to make it possible to apply sufficiently strong transferring discharge to reverse surface of paper guided by a guide plate 29 and sent to the photosensitive drum 15 so that the paper satisfactorily adheres to the photosensitive drum 15, and to transfer a toner image on the paper with the toner image being hardly distorted. In the transferring corona discharger using one discharge wire, if transferring discharge is strengthened, the transferring discharge is strongly applied also to the side near the separating corona discharger 40, so that an image is liable to be distorted.

Furthermore, the power supply to the transferring corona discharger 30 may be one DC high-voltage power supply 35. Accordingly, the transferring corona discharger 30 is of construction simple and low in cost, similarly to the transferring corona discharger using one transferring discharge wire.

The transferring corona discharger 30 which can be combined with the separating corona discharger 40 serving as a separating device according to the present embodiment need not be one in which the wire diameter of the first transferring discharge wire 32 is relatively small, and the wire diameter of the second transferring discharge wire 33 is relatively large, as described above. For example, the wire diameter of the first transferring discharge wire 32 may be relatively large, and the wire diameter of the second transferring discharge wire 33 may be relatively small. Alternatively, the transferring corona discharger 30 comprising three or more transferring discharge wires may be combined with the separating device according to the present invention.

Although in the present embodiment, description was made of a type of enhancing the effect of neutralizing charges by discharge having minus components, the present invention is applicable to a type of discharging having plus components which are opposite thereto. In this case, if the offset value of a high-voltage transformer is set to a value on the plus side, the number of plus components as a primary discharging components in discharge from a first separating wire become larger than those in discharge from a second separating wire.

Figure 12:
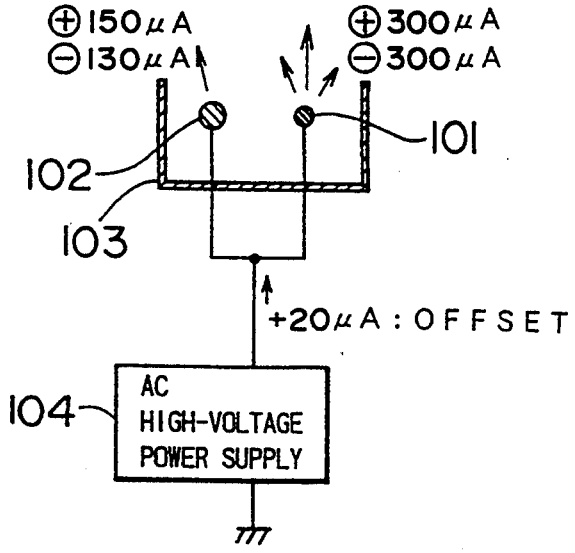
FIG. 12 is a cross sectional view illustrating the construction of a separating device according to another embodiment of the present invention.

More specifically, for example, in a laser beam printer using reversal development, a separating device performing AC discharge having a large number of plus components is used. A separating device according to one embodiment of above type of the present invention is illustrated in FIG. 12. Referring to FIG. 12, numeral 101 designates a first separating discharge wire having a relatively small wire diameter, numeral 102 designates a second separating discharge wire having a relatively small wire diameter, numeral 103 designates a shielding case and numeral 104 designates an AC high-voltage power supply. The AC high-voltage power supply 104 is, for example, a power supply of a constant current type at an offset current and the offset value of AC current outputted therefrom is set on the plus side. For instance, the offset value is set to $+100\ \mu A$. In this case, the first separating discharge wire 101 is liable to discharge, compared with the second separating discharge wire 102. In addition, the discharge having a large number of minus components easily occurs in the first separating discharge wire 101 than in the second separating discharge wire 102. Moreover, the offset current value from the AC high-voltage power supply is $+100\ \mu A$. Taking all of the above conditions into account, the discharge from the wires 101 and 102 is performed, for example, as illustrated in FIG. 12. The substantial amounts of the plus components of discharge are for example $+300\ \mu A$ from the first separating discharge wire 101 and $+150\ \mu A$ from the second separating discharge wire 102, thus, the amount of the plus components of discharge from the first separating discharge wire 101 can be made larger.

Figure 13:
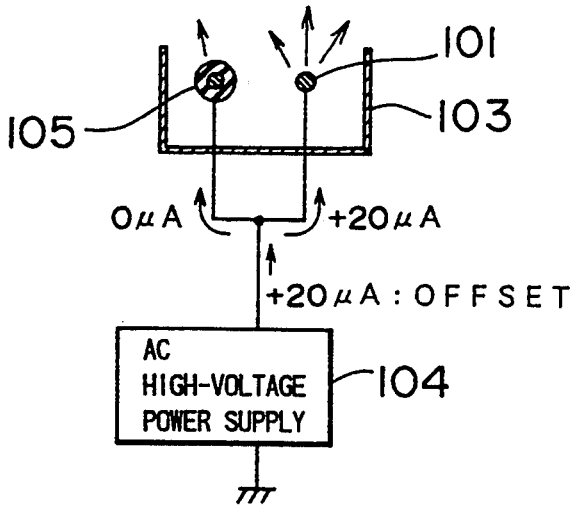
FIG. 13 is a cross sectional view illustrating the construction of a separating device according to still another embodiment of the present invention.
Figure 14:
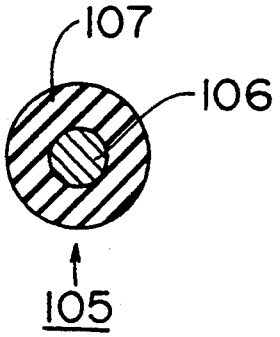
FIG. 14 is a cross sectional view illustrating of a coated wire.

A separating device performing an AC discharge having a large number of plus components can be accomplished by using a coated wire in a second separating discharge wire 105 as shown in FIG. 13. The coated wire 105 is constructed with a tungsten wire having a diameter of for example 50 $\mu m$, which is coated with a dielectric substance 107 as shown in FIG. 14. An outer diameter of the coated wire 105 is for example 100 $\mu A$. As described in U.S. Pat. Nos. 4,086,650 or 4,056,723, the coated wire 105 can be used as a discharge wire. In the case where the coated wire is used as discharge wire in the same condition with the tungsten wire, the amount of discharge from the coated wire is smaller. In addition, the discharge component from the coated wire includes the equal numbers of plus component and minus component. Consequently, when the offset value of AC current outputted from the AC high-voltage power supply is set to $+20\ \mu A$, the offset value of current flowing into the first separating discharge wire (tungsten wire) 101 is, for example, $+20\ \mu A$, and the offset value of current flowing into the second separating discharge wire (coated wire) 105 is, for example, $\pm 0\ \mu A$ as shown in FIG. 13. Accordingly, a larger number of plus components can be included in the discharge from the first separating discharge wire 101.

Above all the embodiments, it is possible to use an AC power supply of a constant voltage type instead of the AC power supply of a constant current type. Also, it is possible to use a alloy wire as a separating discharging wire in all above embodiments.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A separating device for applying a separating discharge to a recording medium used in an electrophotographic image forming apparatus so adapted as to form an electrostatic latent image on the surface of a photoreceptor, develop the electrostatic latent image using toner, transfer a toner image to a sheet-shaped recording medium by adhering a sheet-shaped medium transferred in a predetermined direction to the surface of the photoreceptor and applying a transferring discharge to the recording medium, and to separate the recording medium to which the toner image is transferred from the surface of the photoreceptor by applying a separating discharge to the recording medium, said separating device comprising:

first discharging means;

second discharging means; and alternating current power supply means, the first discharging means being arranged on an upstream side, on the basis of the delivery direction, of the sheet-shaped recording medium and being formed in a shape that provides for easy inducement of discharge relative to the second discharge means;

the second discharging means being arranged on a downstream side, on the basis of the delivery direction, of the sheet-shaped recording medium and being formed in a shape that does not provide for easy discharge relative to the first discharging means; and the alternating-current power supply means being connected to both the first discharging means and the second discharging means for supplying alternating discharge-current to both the first and second discharging means wherein the discharge current flowing through the first and the second discharge means is offset by a predetermined value.

2. The separating device according to claim 1, wherein the first discharging means includes a first discharge wire having a relatively small wire diameter and a first shielding case surrounding the first discharge wire, and the second discharging means includes a second discharge wire having a wire diameter relatively larger than that of the first discharge wire included in the first discharging means and a second shielding case surrounding the second discharge wire.

3. The separating device according to claim 2, wherein at least one of the first and second discharge wires are made from a material selected from the group consisting of tungsten, stainless steel, and an alloy.

4. The separating device according to claim 3, wherein at least one of the wires is coated with a dielectric material.

5. The separating device according to claim 2, wherein the alternating-current power supply means comprises an alternating-current high-voltage power supply of a constant current type at an offset current.

6. The separating device according to claim 2, wherein the second discharge means comprises at least two discharge wires provided with predetermined spacing.

7. The separating device according to claim 6, wherein the wire diameter of the discharge wire provided on the downstream side on the basis of the delivery direction of the sheet-shaped recording medium is larger than that of the discharge wire provided on the upstream side.

8. The separating device according to claim 6, wherein said at least two discharge wires have an equal wire diameter.

9. The separating device according to claim 1, wherein the alternating-current power supply means comprises an alternating-current high-voltage power supply of a constant current type at an offset current.

10. The separating device according to claim 1, wherein the first discharging means includes at least two discharge wires stretched with predetermined spacing and at least two shielding cases surrounding the respective discharge wires, and the wire diameter of the discharge wire provided on the downstream side of the sheet-shaped recording medium is larger than that of the discharge wire provided on the upstream side.

11. The separating device according to claim 1, wherein the second discharging means includes at least two discharge wires provided with predetermined spacing and at least two shielding cases surrounding the respective discharge wires, and the wire diameter of the discharge wire provided on the downstream side of the sheet-shaped recording medium is larger than that of the discharge wire provided on the upstream side.

12. The separating device according to claim 1, wherein the second discharging means includes at least two discharge wires provided with predetermined spacing and at least two shielding cases surrounding the respective discharge wires; and the wire diameters of said two discharge wires are equal to each other.

13. The separating device according to claim 1, wherein the first and second discharging means each include plural needle electrodes with sharpened ends, the plural needle electrodes of the first discharging means each having a small diameter sharpened end relative to the sharpened ends of the needle electrodes of the second discharge means, and the plural needle electrodes of the second discharging means each having a large diameter sharpened end relative to the sharpened ends of the needle electrodes of the first discharging means.

14. The separating device according to claim 1, wherein the first discharging means includes a first plate-shaped electrode having a sharpened edge, and the second discharging means includes a second plate-shaped electrode having a sharpened edge, the sharpened edge of the electrode of the second discharging means having a greater thickness than that of the sharpened edge of the electrode of the first discharging means.

15. A separating device for applying the separating discharge to a recording medium used in an electrophotographic image forming apparatus so adapted as form an electrostatic latent image on the surface of a photoreceptor, develop the electrostatic latent image using toner, transfer a toner image to a sheet-shaped recording medium by adhering a sheet-shaped recording medium transferred in a predetermined direction to the surface of the photoreceptor and applying a transferring discharge to the recording medium, and to separate the recording medium to which the toner image is transferred from the surface of the photoreceptor by applying a separating discharge to the recording medium, said separating device comprising:

a shielding case;

a first discharge wire provided on the upstream side, on the basis of the delivery direction, of the sheet-shaped recording medium, in said shielding case, and having a relatively small wire diameter;

a second discharge wire provided on the downstream side, on the basis of the delivery direction, of the sheet-shaped recording medium, in said shielding case, and having a wire diameter relatively larger than that of the first discharge wire; and alternating-current power supply means connected to both the first discharge wire and the second discharge wire for supplying alternating discharge-current in parallel to the first discharge wire and the second discharge wire wherein the discharge current flowing through said first and said second discharge wires is offset by a predetermined value.

16. The separating device according to claim 15, wherein at least one of the first and second discharge wires are made from a material selected from the group consisting of tungsten, stainless steel, and an alloy.

17. The separating device according to claim 16, wherein the shielding case includes a case formed by a folded thin metal plate which is highly conductive.

18. The separating device according to claim 16, wherein at least one of the wires is coated with a dielectric material.

19. The separating device according to claim 15, wherein the alternating-current power supply means comprises an alternating-current high-voltage power supply of a constant current type.

20. A separating device for applying the separating discharge to a recording medium used in an electrophotographic image forming apparatus adapted so as to form an electrostatic latent image on the surface of a photoreceptor, develop the electrostatic latent image using toner, transfer a toner image to a sheet-shaped recording medium by adhering a sheet-shaped recording medium transferred in a predetermined direction to the surface of the photoreceptor and applying a separating discharge to the recording medium, and to separate the recording medium to which the toner image is transferred from the surface of the photoreceptor by applying a transferring discharge to the recording medium, said separating device comprising:

a shielding case having an open upper part and a bottom surface which is substantially parallel to the delivery direction of the sheet-shaped recording medium, the case further having a side surface on an upstream side and on a downstream side extending upward from an edge of the bottom surface, at least two discharge wires having predetermined spacing provided in a substantially perpendicular orientation to the delivery direction and mounted in proximity relatively close to the bottom surface in said shielding case, and a first grid wire means which includes a first grid wire and a second grid wire means which includes a second grid wire, the first and second grid wires having different diameters and being provided with predetermined spacing, and being substantially parallel to the delivery direction, and being spaced from the bottom surface of said shielding case.

21. The separating device according to claim 20, wherein the first grid wire means includes another grid wire spaced apart from the first grid wire, the wires of the first grid wire means having a diameter and extending in parallel to the delivery direction of the upstream side, in the delivery direction, the second grid wire includes another grid wire spaced apart from the second grid wire, the wires of the second grid wire means having a diameter relatively larger than those of the first grid wire means and extending in parallel to the delivery direction on the downstream side, in the delivery direction.

* * * * *